US012551018B2

(12) United States Patent
Xiao

(10) Patent No.: US 12,551,018 B2
(45) Date of Patent: Feb. 17, 2026

(54) SUPPORT STRUCTURE AND SEAT

(71) Applicant: Guangdong Best Home Furniture Co., Ltd., Guangdong (CN)

(72) Inventor: Jianguo Xiao, Guangdong (CN)

(73) Assignee: Guangdong Best Home Furniture Co., Ltd., Zhongshan (CN)

( * ) Notice: Subject to any disclaimer, the term of this patent is extended or adjusted under 35 U.S.C. 154(b) by 192 days.

(21) Appl. No.: 18/533,249

(22) Filed: Dec. 8, 2023

(65) Prior Publication Data

US 2024/0099468 A1 Mar. 28, 2024

Related U.S. Application Data

(63) Continuation of application No. PCT/CN2021/105110, filed on Jul. 8, 2021.

(30) Foreign Application Priority Data

Jun. 11, 2021 (CN) ..... 202110653813.0

(51) Int. Cl.
*A47C 7/50* (2006.01)

(52) U.S. Cl.
CPC ..... *A47C 7/5068* (2018.08); *A47C 7/5062* (2018.08); *A47C 7/5066* (2018.08); *A47C 7/506* (2013.01)

(58) Field of Classification Search
CPC ..... A47C 7/506; A47C 7/5062; A47C 7/5066; A47C 7/5068
See application file for complete search history.

(56) References Cited

U.S. PATENT DOCUMENTS

| | | | | |
|---|---|---|---|---|
| 10,631,652 | B2 * | 4/2020 | Mackert | A47C 7/5062 |
| 10,638,847 | B2 * | 5/2020 | Mackert | A47C 7/5068 |
| 11,930,937 | B2 * | 3/2024 | Mackert | A47C 1/0345 |
| 11,963,616 | B2 * | 4/2024 | Mackert | A47C 1/0352 |
| 12,022,951 | B2 * | 7/2024 | Lu | A47C 1/037 |

(Continued)

FOREIGN PATENT DOCUMENTS

| | | | | |
|---|---|---|---|---|
| CN | 207477253 U | * | 6/2018 | A47C 7/506 |
| CN | 109984504 A | * | 7/2019 | A47C 7/506 |

(Continued)

OTHER PUBLICATIONS

International Search Report of PCT Patent Application No. PCT/CN2021/105110 issued on Feb. 28, 2022.

*Primary Examiner* — Rodney B White

(57) ABSTRACT

Disclosed in the present disclosure is a support structure and a seat, relating to the technical field of mechanical structures, including a seat frame assembly, a footrest assembly, and a motion-driving assembly, wherein the support structure further includes a first reset elastic member provided on the seat frame assembly and connected to the motion-driving assembly or the footrest assembly, and the first reset elastic member applies a reset elastic force to directly or indirectly drive the footrest assembly to rotate with respect to the seat frame assembly to retract. The support structure and the seat provided in the present disclosure adopts a first reset elastic member to assist footrest retraction, reducing a force required to retract the footrest assembly, with fast retraction speed, providing advantages of convenience, labor-saving and swiftness.

16 Claims, 4 Drawing Sheets

(56) References Cited

U.S. PATENT DOCUMENTS

| | | | | |
|---|---|---|---|---|
| 12,239,240 | B2 * | 3/2025 | Li | A47C 7/144 |
| 2025/0057711 | A1 * | 2/2025 | Ohruh | A61G 5/128 |
| 2025/0134263 | A1 * | 5/2025 | Lin | A47C 1/03211 |

FOREIGN PATENT DOCUMENTS

| | | | | |
|---|---|---|---|---|
| CN | 112155356 | A | 1/2021 | |
| DE | 202007004695 | U1 * | 8/2008 | A47C 1/0347 |
| DE | 102015106922 | A1 * | 11/2016 | A47C 7/5062 |
| DE | 102017100637 | A1 | 7/2018 | |

* cited by examiner

A-A

B–B

SUPPORT STRUCTURE AND SEAT

CROSS-REFERENCE TO RELATED APPLICATIONS

The present is a Continuation Application of PCT Application No. PCT/CN2021/105110 filed on Jul. 8, 2021, which application claims priority of Chinese Patent Application No. 202110653813.0 filed on Jun. 11, 2021 before CNIPA. All the above are hereby incorporated by reference in their entirety.

FIELD

The present disclosure relates to the technical field of mechanical structures and, particularly, to a support structure, or more specifically to a seat.

BACKGROUND

Ordinary furniture seat does not typically come with a footrest device. When people relax and rest on the seat, due to the lack of support for the feet, people feel less relaxed and comfortable. If a separate external footrest is mounted, it takes up more space, which is not conducive to storage, and a height of the footrest is inconvenient to match a height of the seat.

Disclosed in the prior art are seats with footrests that extend out from or are stored in a bottom of the seat with the cooperation of a link mechanism and a rotating mechanism.

For example, a German patent application with Publication No. DE102017100637A1 discloses a footrest structure and seating furniture. In the solution disclosed in this patent application, the rear pedal assembly is driven to rotate with the assistance of a motion-driving assembly, and with the assistance of a link motion assembly, the following of the front pedal assembly is achieved simultaneously, realizing the forward extension of the front pedal assembly when the rear pedal assembly is rotated outwardly or the backward moving storage of the front pedal assembly when the rear pedal assembly is rotated inwardly.

Also disclosed in this foot pedal structure is the use of a handle or a motor for driving the rotation of a motion-driving assembly, however, in the solution adopting a handle as a driving member, the retraction is inconvenient and laborious since both retraction and extension require manual manipulation of the rotating shaft. Particularly, in the retraction process, it requires the handle to be rotated and an elastic force of the pre-tensioned spring provided to assist in the extension of the front pedal link to be overcome.

SUMMARY

In order to overcome the at least one of deficiencies mentioned above in the prior art, a first objective of the present disclosure is to provide a support structure.

The technical solutions adopted in the present disclosure to solve the problems are as follows.

A support structure includes:

a seat frame assembly;

a footrest assembly, rotatably connected to the seat frame assembly;

a motion-driving assembly, used to drive the footrest assembly to rotate with respect to the seat frame assembly; and a first reset elastic member, provided on the seat frame assembly and connected to the motion-driving assembly or the footrest assembly, wherein the first reset elastic member applies a reset elastic force to directly or indirectly drive the footrest assembly to rotate with respect to the seat frame assembly to retract.

The support structure provided in the present disclosure includes a first reset elastic member driving the footrest assembly directly or indirectly to rotate with respect to the seat frame assembly so as to facilitate the footrest assembly to retract, solving the problems of inconvenient footrest retraction and laborious footrest retraction in the prior art, achieving the advantages of labor-saving and swiftness.

In a possible implementation, the support structure further includes a fixed mounting base and a support link, in which the seat frame assembly, swingable up and down, is hinged to the fixed mounting base, and both ends of the support link are rotatably connected to the motion-driving assembly and the fixed mounting base respectively; and with the footrest assembly in an outwardly open state, when the seat frame assembly is compressed and swings downwardly with respect to the fixed mounting base, the seat frame assembly drives the motion-driving assembly to self-lock by means of the support link.

In a possible implementation, the support structure further includes an elastic reset mechanism provided between the fixed mounting base and the seat frame assembly, in which the elastic reset mechanism is used to drive the seat frame assembly to rotate with respect to the fixed mounting base to achieve a reset.

In a possible implementation, the elastic reset mechanism includes a reset rotating shaft and a compression spring; the seat frame assembly is hinged to the fixed mounting base by means of the reset rotating shaft; the reset rotating shaft is fixed to the seat frame assembly;

the reset rotating shaft is fixedly connected with a reset plate; the fixed mounting base is fixed with a stud; the stud passes through the reset plate and is threaded to a fixing nut; the compression spring is sleeved on the stud; an end of the compression spring is abutted against the fixing nut; and an opposite end of the compression spring applies an elastic force to the reset plate so that the reset plate is abutted against to the fixed mounting base.

In a possible implementation, the motion-driving assembly includes a rotatably connectable rotating shaft, a rear driving link, a middle driving link, and a front driving link sequentially; the rotating shaft is rotatably connected to the seat frame assembly; the front driving link is rotatably connected to the footrest assembly; and the first reset elastic member is connected to at least one of the following: the rotating shaft, the rear driving link, the middle driving link and the front driving link.

In a possible implementation, a first crank hinged to the rear driving link and a second crank hinged to the support link are both fixed to the rotating shaft; and with the footrest assembly in an outwardly open state, when the seat frame assembly is compressed and swings downwardly with respect to the fixed mounting base, the seat frame assembly drives the rotating shaft to rotate so that a hinge point of the first crank and the rear driving link is maintained at or bypassed at a dead center for self-locking of the motion-driving assembly.

In a possible implementation, a restricting block for restricting a rotation angle of the first crank is fixed to the seat frame assembly, and the restricting block is positioned between the rotating shaft and the middle driving link.

In a possible implementation, the support structure further includes a handle in transmission connection with the motion-driving assembly.

In a possible implementation, the support structure further includes a linear extendable assembly in transmission connection with the motion-driving assembly.

Based on the same inventive concept, a second aspect of the present disclosure is to provide a seat including a support structure mentioned above.

The seat provided in the present disclosure adopts a support structure that may be retracted in a quick and labor-saving manner so as to provide the advantage of being easy to use, having relatively good application and market prospects.

Figure 1:
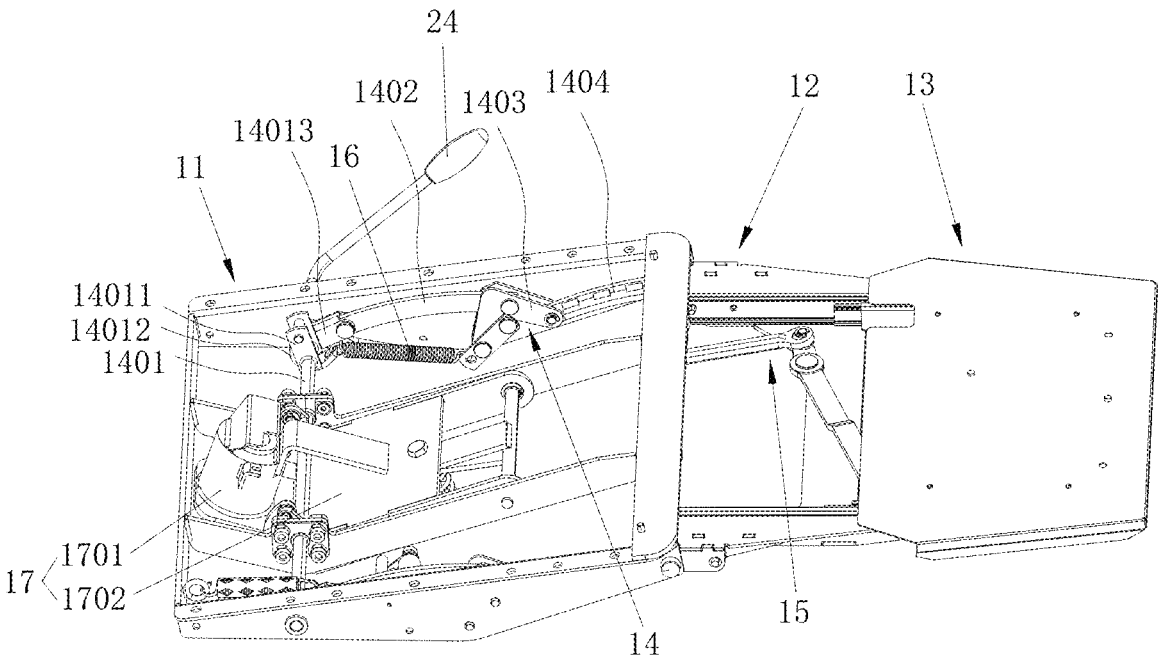
FIG. 1 is a structural diagram of the support structure in an embodiment of the present disclosure.

The meanings of the attached markings are as follows:

11 seat frame assembly; 1101 restricting block; 12 rear footrest assembly; 13 front footrest assembly; 14 motion-driving assembly; 1401 rotating shaft; 14011 fixing crank; 14012 rotating crank; 14013 first crank; 1402 rear driving link; 1403 middle driving link; 1404 front driving link; 15 motion link assembly; 16 first reset elastic member; 17 fixed mounting base; 1701 mounting sleeve; 1702 fixing plate; 18 second crank; 19 support link; 20 reset rotating shaft; 21 second reset elastic member; 22 reset plate; 23 stud; 2301 fixing nut; 24 handle; 25 linear extendable link; 2501 driving crank.

DETAILED DESCRIPTION OF THE EMBODIMENTS

For a better understanding and implementation, the technical solutions in the embodiments of the present disclosure are clearly and completely described below in conjunction with the attached drawings of the present disclosure.

In the description of the present disclosure, it is to be noted that the terms "up", "down", "front", "back", "left", "right", "vertical", "horizontal", "top", "bottom", "inside", "outside" and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure.

Unless otherwise defined, all terms including technical and scientific terms used herein have the same meaning as commonly understood by those skilled in the art to which the present disclosure belongs. The terms used herein in the specification of the present disclosure are used only to describe specific embodiments and are not intended as a limitation of the disclosure.

Embodiment 1

Referring to FIGS. 1-7, disclosed in the present disclosure is a support structure, including a seat frame assembly 11 and a footrest assembly, in which the footrest assembly includes a rear footrest assembly 12 and a front footrest assembly 13.

The rear footrest assembly 12 is rotatably connected to the seat frame assembly 11.

The front footrest assembly 13 is connected to the seat frame assembly 11 and is slidable with respect to the rear footrest assembly 12.

The motion-driving assembly 14 is used to drive the rear footrest assembly 12 to rotate with respect to the seat frame assembly 11.

The motion link assembly 15 is used to drive the front footrest assembly 13 to move with respect to the rear footrest assembly 12 when the motion-driving assembly 14 drives the rear footrest assembly 12 to rotate.

The rear footrest assembly 12, the front footrest assembly 13, the motion-driving assembly 14, and the motion link assembly 15 mentioned above are not the primary inventive points to be protected by the present disclosure. The specific structures of the rear footrest assembly 12, the front footrest assembly 13, the motion-driving assembly 14, and the motion link assembly 15 may be referred to the German patent application with Publication No. DE102017100637A1.

The support structure further includes a first reset elastic member 16 provided on the seat frame assembly 11 and connected to the motion-driving assembly 14 or the rear footrest assembly 12, in which the first reset elastic member 16 applies a reset elastic force to the motion-driving assembly 14 so that the motion-driving assembly 14 drives the rear footrest assembly 12 to rotate with respect to the seat frame assembly 11 to retract, or the first reset elastic member 16 drives the rear footrest assembly 12 to rotate directly with respect to the seat frame assembly 11 to retract.

For facilitating description, the process of rotating the rear footrest assembly 12 outwardly with respect to the seat frame assembly 11 to extend the footrest is defined as a forward rotation of the rear footrest assembly 12, and accordingly, reverse rotation of the rear footrest assembly 12 refers to the process of rotating the rear footrest assembly 12 backwardly with respect to the seat frame assembly 11 to shorten the footrest and to store it.

The first reset elastic member 16 applies a reset elastic force to the motion-driving assembly 14, so that the motion-driving assembly 14 applies a reverse rotation driving force to the rear footrest assembly 12, or the first reset elastic member 16 applies a reset elastic force to the rear footrest assembly 12 directly to cause reverse rotation of the rear footrest assembly 12, which assists in the retraction of the footrest, thereby achieving labor-saving and efficient retraction. It is particularly suitable for footrest devices with manually operated footrest extensions, and power consumption may also be reduced by applying it to footrest devices with motorized footrest extensions or retractions.

Referring to FIG. 1, in the present embodiment, the motion-driving assembly 14 includes a rotatably connectable rotating shaft 1401, a rear driving link 1402, a middle driving link 1403, and a front driving link 1404 sequentially; the rotating shaft 1401 is rotatably connected to the seat frame assembly 11; the front driving link 1404 is rotatably connected to the front footrest assembly 13.

For facilitating description, accordingly, the rotating shaft 1401 is rotated forward, so that a process of the motion-driving assembly 14 driving the rear footrest assembly 12 to rotate forward is defined as a forward rotation of the motion-driving assembly 14. Accordingly, the rotating shaft 1401 is rotated in reverse, so that a process of a reverse rotation of the motion-driving assembly 14 is a process that the motion-driving assembly 14 drives the rear footrest assembly 12 to rotate backwardly with respect to the seat frame assembly 11 to shorten the footrest and store it.

Figure 3:
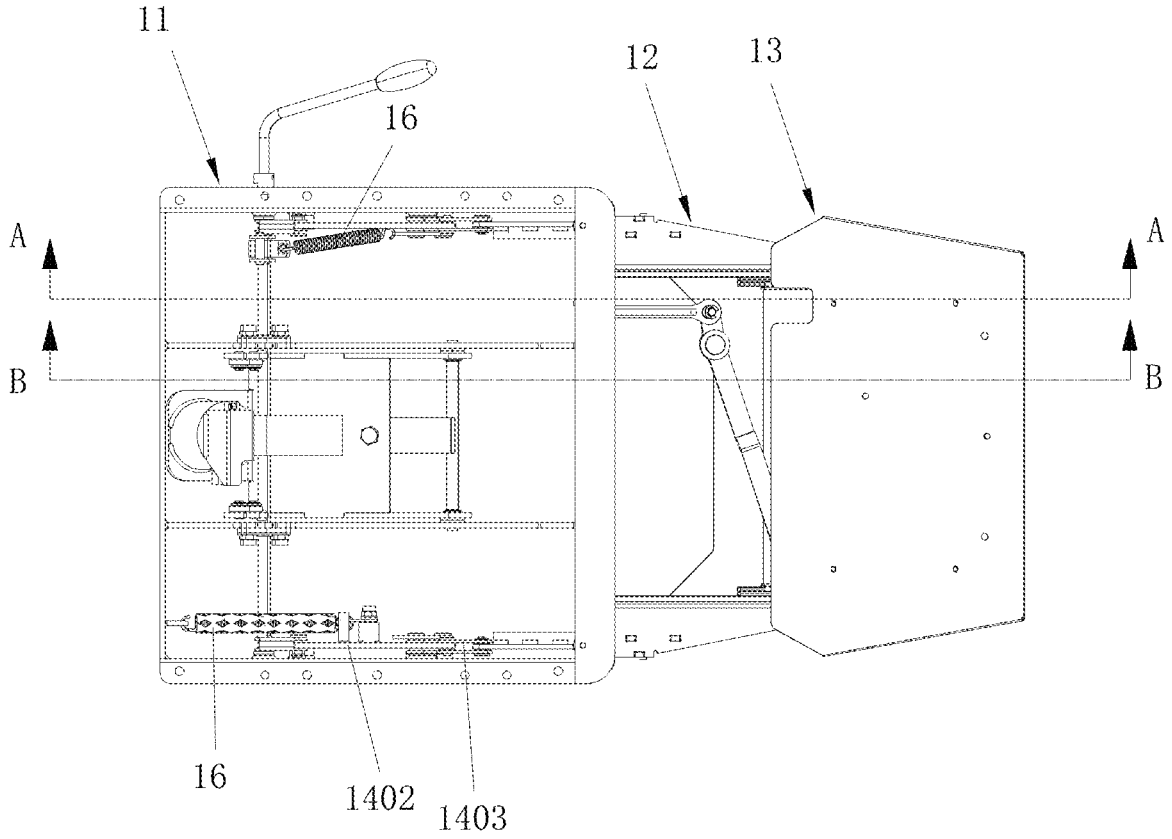
FIG. 3 is a top view of the support structure in an embodiment of the present disclosure.

Referring to FIG. 1 and FIG. 3, the first reset elastic member 16 is connected to at least one of the following: the rotating shaft 1401, the rear driving link 1402, the middle driving link 1403, and the front driving link 1404. The first reset elastic member 16 applies a force to the rotating shaft 1401 directly or indirectly, so that the rotating shaft 1401 rotates in reverse and sequentially drives the rear driving link 1402, the middle driving link 1403, and the front driving link 1404 to move backwardly and retract, thereby driving the rear footrest assembly 12 to rotate in reverse and achieving the objective of assisting retraction of the footrest.

Further, for facilitating description, the seat frame assembly 11 is partitioned into a front end and a rear end, in which a front end of the seat frame assembly 11 is an end thereof proximal to a connection with the rear footrest assembly 12, and a rear end of the seat frame assembly 11 is an end thereof proximal to a connection with the rotating shaft 1401.

Further, referring to FIG. 1 and FIG. 3, in the present embodiment, the first reset elastic member 16 is a tension spring. The rotating shaft 1401 is fixedly provided with a fixing crank 14011. The fixing crank 14011 is hinged to a rotating crank 14012. An end of the first reset elastic member 16 is connected to the rotating crank 14012, and an opposite end thereof is connected to the seat frame assembly 11. Specifically, in the present embodiment, the end of the first reset elastic member 16 connected to the rotating crank 14012 is positioned on a side of the rotating shaft 1401 proximal to a rear end of a cushion. The first reset elastic member 16 applies a counter-clockwise reset elastic force to the rotating shaft 1401 by the rotating crank 14012, so that the rotating shaft 1401 has a tendency to rotate in reverse.

In another possible implementation, the first reset elastic member 16 may also be provided on a side of the rotating shaft 1401 toward a rear end of the seat frame assembly 11. The first reset elastic member 16 connecting to a rear end of the seat frame assembly 11 may also achieve an objective of applying a reverse reset elastic force to the rotating shaft 1401.

Further and preferably, the rotating crank 14012 is arc-shaped.

The rotating crank 14012 is set as arc-shaped so that an arcuate surface may be attached to a surface of the rotating shaft 1401 when the rotating crank 14012 is subjected to a tension force of the first reset elastic member 16, increasing a contact area between the rotating crank 14012 and the rotating shaft 1401, and decreasing the possibility of the rotating crank 14012 being broken by force. Additionally, the arc-shaped rotating crank 14012 is more conducive to applying a rotating torque to the rotating shaft 1401, thereby assisting in resetting the footrest.

Figure 2:
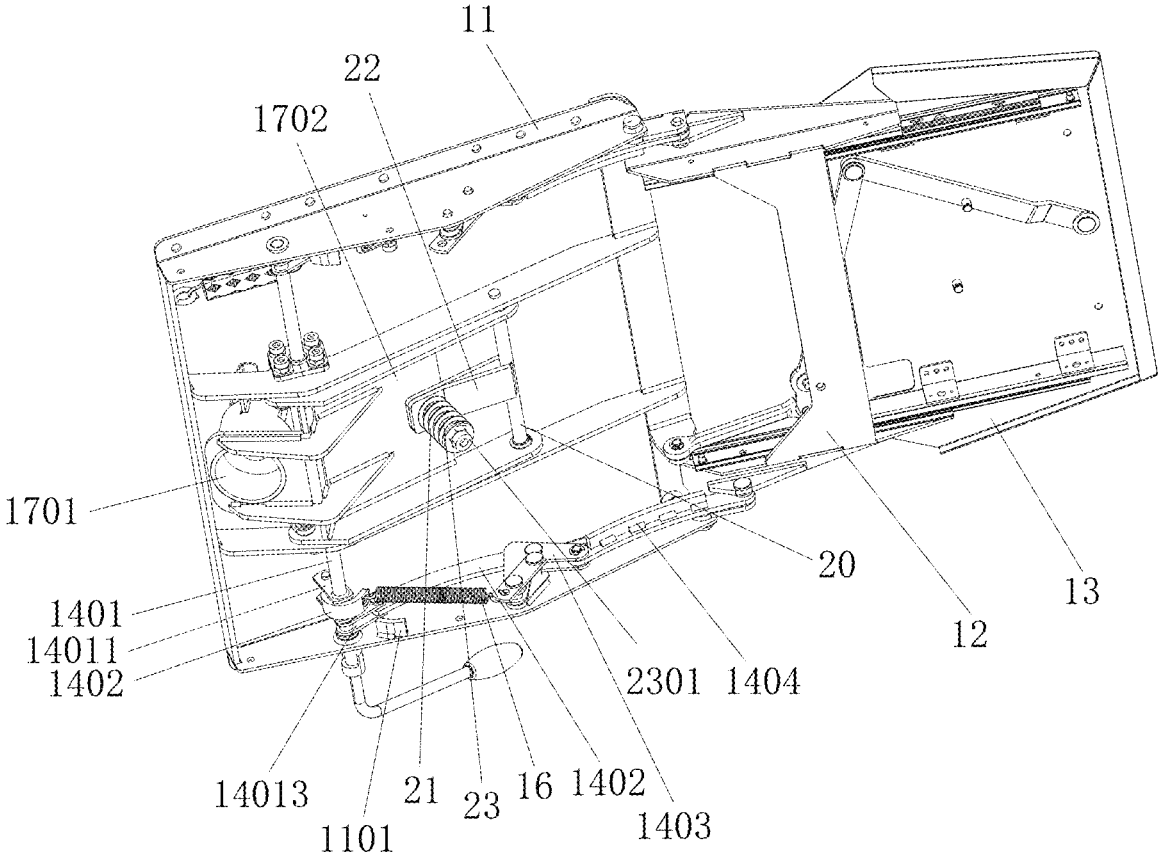
FIG. 2 is another view of the support structure in an embodiment of the present disclosure.
Figure 4:
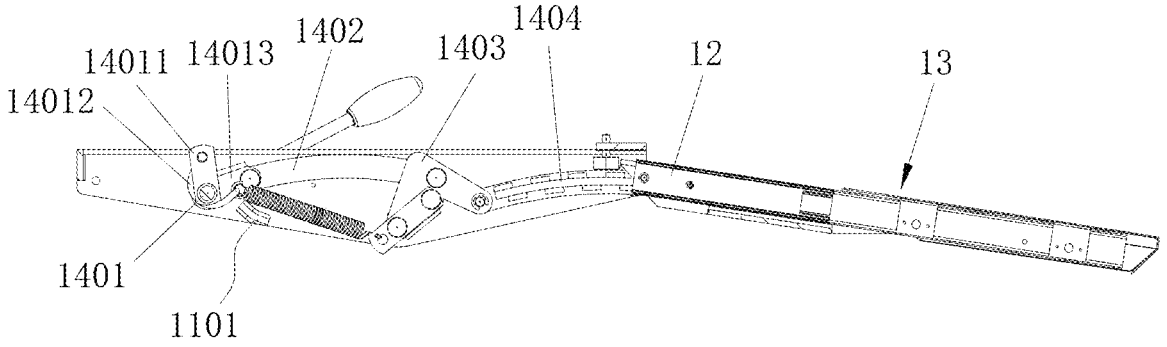
FIG. 4 is a cross-sectional view of FIG. 3 taken along a line A-A.

Referring to FIG. 2 and FIG. 4, in a possible implementation, a first crank 14013 is fixed on the rotating shaft 1401, and the first crank 14013 is hinged to the rear driving link 1402.

When a rotation center of the rotating shaft 1401, a hinge point between the first crank 14013 and the rear driving link 1402, and a hinge point between the rear driving link 1402 and the middle driving link 1403 are in a straight line, the hinge point between the first crank 14013 and the rear driving link 1402 is positioned in a dead center position, and in this case, the motion-driving assembly 14 is in a self-locking state.

Alternatively, in a preferable implementation, a restricting block 1101 is fixed on the seat frame assembly 11. The restricting block 1101 is positioned between the rotating shaft 1401 and the middle driving link 1403. The restricting block 1101 is used to restrict a rotation angle of the first crank 14013. The restricting block 1101 may be set in terms of the followings: a rotation center of the rotating shaft 1401, a hinge point between the first crank 14013 and the rear driving link 1402, and a hinge point between the rear driving link 1402 and the middle driving link 1403 are in a straight line when a hinge point between the first crank 14013 and the rear driving link 1402 is abutted against the restricting block 1101, i.e., the hinge point between the first crank 14013 and the rear driving link 1402 being at a dead center position.

Alternatively, in a preferable implementation, when a hinge point between the first crank 14013 and the rear driving link 1402 is abutted against the restricting block 1101, an included angle a is formed between the first crank 14013 and the first crank 14013 when it is in the dead center position, with a ranging from $0<a\leq10°$, and a preferred angle a is $0<a\leq0.5°$.

When the included angle a is formed between the first crank 14013 and the first crank 14013 when it is in the dead center position and $0<a\leq0.5°$, the locking performance is stable and the reset elastic force required for resetting is relatively small.

Figure 5:
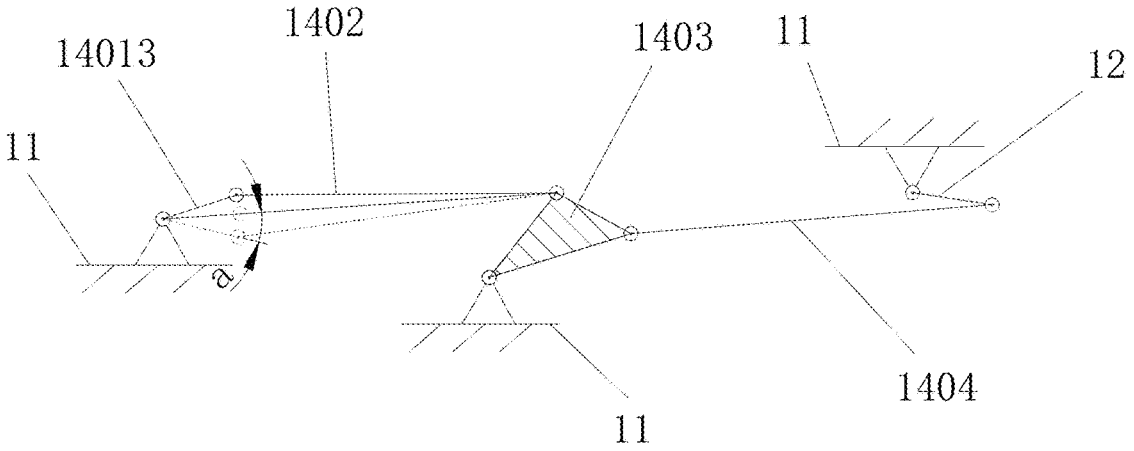
FIG. 5 is a structural principal diagram of the motion-driving assembly in the support structure in an embodiment of the present disclosure.

Referring to FIG. 5, a linkage mechanism, formed by the first crank 14013, the rear driving link 1402, the middle driving link 1403, and the front driving link 1404, has a dead center, i.e., a self-locking point. A dead center position occurs when a rotation center of the rotating shaft 1401, a hinge point between the first crank 14013 and the rear driving link 1402, and a hinge point between the rear driving link 1402 and the middle driving link 1403 are in a straight line. There are theoretically two dead center positions, one of which is positioned on a side of rotating shaft 1401 distal to the middle driving link 1403, i.e., a distal dead center position, and the other of which is positioned between the rotating shaft 1401 and the middle driving link 1403, i.e., a proximal dead center position. The dead center position referred in the present embodiment is the proximal dead center position.

The support structure further includes a locking structure (not labeled in figures) that allows the hinge point between the first crank 14013 and the rear driving link 1402 to be abutted against the restricting block 1101.

The locking structure allows the hinge point between the first crank 14013 and the rear driving link 1402 to be abutted against the restricting block 1101 so that the linkage mechanism forms a self-locking, in which the linkage mechanism is formed by the first crank 14013, the rear driving link 1402, the middle driving link 1403, and the front driving link 1404, thereby stabilizing the footrest in an extended state.

Further, in the present embodiment, the support structure further includes a fixed mounting base 17. The fixed mounting base 17 is provided with a mounting sleeve 1701 and a fixing plate 1702. The mounting sleeve 1701 is used to connect a support base. The fixing plate 1702 is fixed with the mounting sleeve 1701 obliquely. The support base is a structure of the prior art, which is not shown in figures.

A side of the seat frame assembly 11 proximal to a connection with the rear footrest assembly 12 is rotatably connected to the fixing plate 1702. The locking structure includes a second crank 18 and a support link 19. The second crank 18 is fixedly connected to the rotating shaft 1401. Both ends of the support link 19 are rotatably connected to the second crank 18 and the fixing plate 1702 respectively.

Figure 6:
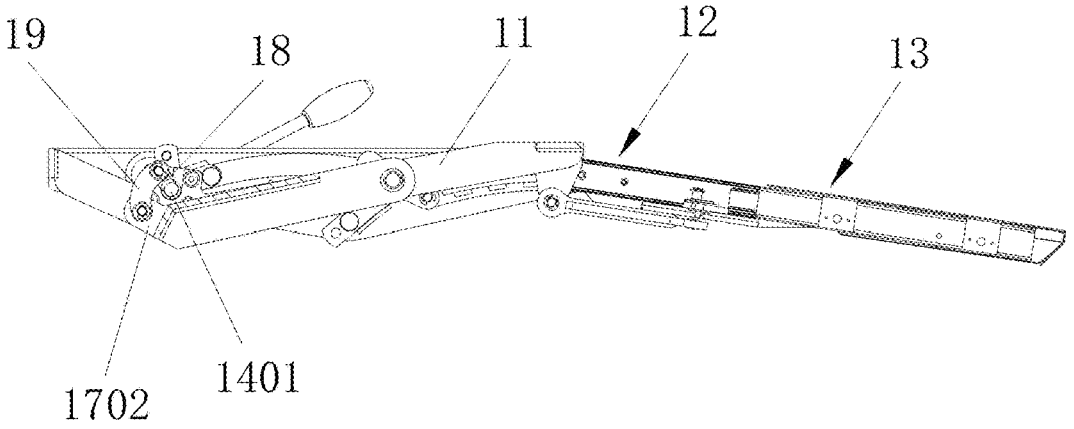
FIG. 6 is a cross-sectional view of FIG. 3 taken along a line B-B.
Figure 7:
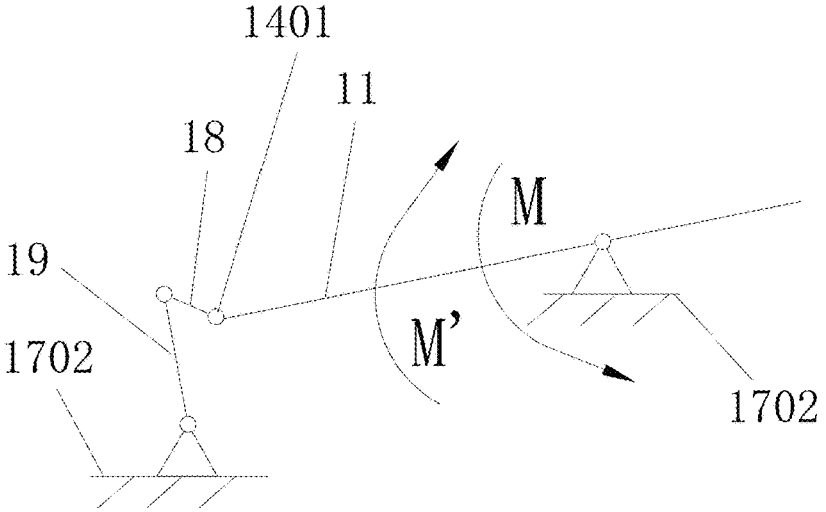
FIG. 7 is a structural principal diagram of the locking structure in the support structure in an embodiment of the present disclosure.

Referring to FIG. 6 and FIG. 7, the second crank 18, the support link 19, the fixing plate 1702, and the seat frame assembly 11 are formed a four-bar mechanism. When a person is seated on the seat frame assembly 11 or pressure is applied to a rear end of the seat frame assembly 11, the seat frame assembly 11 rotates around a connecting position between the seat frame assembly 11 and the fixing plate 1702. The rotation process is that a rear end of the seat frame assembly 11 is lowered while a front end thereof is lifted, thereby changing an inclination of the seat frame assembly 11. Additionally, the pressure applied on the seat frame assembly 11 results in a moment M, in which the moment M overcomes a reset elastic force of the first reset elastic member 16, so that the rotating shaft 1401 is unable to rotate which achieves the locking of the rotating shaft 1401. The fixation of the rotating shaft 1401 and the first crank 14013 allows the linkage mechanism to form a self-locking, in which the linkage mechanism is formed by the first crank 14013, the rear driving link 1402, the middle driving link 1403, and the front driving link 1404.

Further, in a possible implementation, the support structure further includes a reset mechanism (not labeled in figures). The reset mechanism is used to drive the seat frame assembly 11 to rotate around a connecting point between the seat frame assembly 11 and the fixing plate 1702 to achieve a reset. When resetting, the seat frame assembly 11 is rotated in a state in which an end thereof connected to the rear footrest assembly 12 is lowered while an end thereof connected to the rotating shaft 1401 is lifted.

The reset mechanism allows a reset of the inclination of the seat frame assembly 11 after a person stands up or the pressure applied on the rear end of the seat frame assembly 11 is removed. Reducing the elastic force required for the first reset elastic member 16, in another way, also serves to assist in the retraction of the footrest, which is conducive to reducing the difficulty of structural design as well as production processing and manufacturing.

In the present embodiment, the reset mechanism includes a reset rotating shaft 20 and a second reset elastic member 21. The reset rotating shaft 20 is provided on the seat frame assembly 11 at a connecting position between the seat frame assembly 11 and the fixing plate 1702. The reset rotating shaft 20 is fixed to the seat frame assembly 11. The reset rotating shaft 20 is rotatably connected to the fixing plate 1702. The second reset elastic member 21 is provided on the fixing plate 1702 and is connected to the reset rotating shaft 20. The second reset elastic member 21 applies a torque to the reset rotating shaft 20 to drive the reset rotating shaft 20 to rotate so as to drive the seat frame assembly 11 to reset.

Referring to FIG. 7, the second reset elastic member 21 applies a reset elastic force to the reset rotating shaft 20 through the fixing plate 1702, i.e., resulting in a reset torque, which is the M' as shown in the figure. The torque M' allows the seat frame assembly 11 to have a tendency to rotate around a connecting point between the seat frame assembly 11 and the fixing plate 1702 to reset, that is, causing a front end of the seat frame assembly 11 to be lowered and a rear end thereof to be lifted, or namely, the seat frame assembly 11 rotates clockwise around the connecting point between the seat frame assembly 11 and the fixing plate 1702.

Further, in the present embodiment, the reset rotating shaft 20 is fixedly connected with a reset plate 22. The second reset elastic member 21 is a spring. An end of the second reset elastic member 21 is connected to the fixing plate 1702, and an opposite end thereof is connected to the reset plate 22.

Further, referring to FIG. 2, the second reset elastic member 21 is a compression spring. A stud 23 is fixed on the fixing plate 1702. The reset plate 22 is provided with a through-hole (not labeled in figures). The stud 23 passes through the through-hole on the reset plate 22. The second reset elastic member 21 is sleeved on the stud 23. An end of the stud 23 distal to the fixing plate 1702 is threaded with a fixing nut 2301. An end of the second reset elastic member 21 is abutted against the fixing nut 2301, and an opposite end thereof applies an elastic force to the reset plate 22, so that the reset plate 22 is abutted against the fixing plate 1702.

Embodiment 2

The present embodiment differs from embodiment 1 only in that the first reset elastic member 16 is a torsion spring, in which an end of the first reset elastic member 16 is connected to the seat frame assembly 11, and an opposite end thereof is connected to the rear footrest assembly 12. The first reset elastic member 16 applies a torque to the rear footrest assembly 12.

Embodiment 3

The present embodiment differs from embodiment 1 only in that the first reset elastic member 16 is a torsion spring, in which an end of the torsion spring is connected to the seat frame assembly 11, and an opposite end thereof is connected to the rotating shaft 1401. The first reset elastic member 16 applies a torque to the rotating shaft 1401, so that the rotating shaft 1401 has a tendency to rotate in reverse, which may assist the motion-driving assembly 14 to rotate in reverse, thereby driving the rear footrest assembly 12 to rotate in reverse to retract the footrest.

Embodiment 4

The present embodiment differs from embodiment 1 only in that the locking structure is a lock pin (not shown in figures). A lateral part of the seat frame assembly 11 is provided with a through-hole for passing through the lock pin. The lock pin passes through the through-hole to be abutted against the first crank 14013, or the rear driving link 1402, or a connecting position between the first crank 14013 and the rear driving link 1402, so that a hinge point between the first crank 14013 and the rear driving link 1402 is abutted against the restricting block 1101 to achieve locking. The hinge point between the first crank 14013 and the rear driving link 1402 is fixed by the lock pin to achieve locking. Such a process is slightly less convenient than that in embodiment 1 due to the need to insert and remove the lock pin repeatedly.

Embodiment 5

The present embodiment differs from embodiment 1 only in that the reset mechanism includes a spring, in which an end of the spring is connected to the fixed mounting base 17, and an opposite end of the spring is connected to the seat frame assembly 11, the spring applying a torque to the seat frame assembly 11 that allows the seat frame assembly 11 to rotate around a connection point between the seat frame assembly 11 and the fixing plate 1702.

It is sufficient for the spring to provide a torque to the seat frame assembly 11 that allows the seat frame assembly 11 to rotate around a connection point between the seat frame assembly 11 and the fixing plate 1702, so that the torque may drive a front end of the seat frame assembly 11 to be lowered and a rear end thereof to be lifted.

In a possible implementation, the spring is a compression spring, and the spring is positioned on a side of the seat frame assembly 11 distal to the rear footrest assembly 12.

In another possible implementation, the spring is a tension spring, and the spring is positioned on a side of the seat frame assembly 11 proximal to the rear footrest assembly 12.

Embodiment 6

The present embodiment differs from embodiment 1 only in that the reset mechanism includes a linear extendable link, in which an end of the linear extendable link is hinged to the fixed mounting base 17, and an opposite end thereof is hinged to the seat frame assembly 11.

The linear extendable link may be connected to a front end of the seat frame assembly 11, or may be connected to a rear end of the seat frame assembly 11, or may be provided both at a front end and a rear end of the seat frame assembly 11.

A reset torque is provided to the seat frame assembly 11 by a linear extendable link, allowing the seat frame assembly 11 to rotate around a connecting position between the seat frame assembly 11 and the fixing plate 1702 in a state in which a front end thereof is lowered and a rear end thereof is lifted.

Further, the linear extendable link may be a motorized extendable link, a pneumatic extendable link, or a hydraulic extendable link.

Embodiment 7

The present embodiment differs from embodiment 1 only in that the second reset elastic member 21 is a tension spring. An end of the second reset elastic member 21 is fixed to the fixing plate 1702, and an opposite end thereof is fixed to the reset plate 22. The second reset elastic member 21 applies an elastic force to the reset plate 22 so that the reset plate 22 is abutted against the fixing plate 1702. By applying a tension force to the fixing plate 1702 through a tension spring, the reset plate 22 is abutted against the fixing plate 1702, which also achieves the objective of providing a reset torque to the reset rotating shaft 20 and realizing the reset of the seat frame assembly 11.

Embodiment 8

Disclosed in the present disclosure is a seat, including any one of the support structures in the above-mentioned embodiments. The seat further includes a backrest, a support base, a seat cushion and other components, which are all the structures of the prior art and not shown in figures, which is not repeated hereby.

Further, the seat further includes a driving member for driving the motion-driving assembly 14 to move.

In a possible implementation, referring to FIG. 1, the driving member is a handle 24. The handle 24 is fixedly connected to the driving shaft and is used to drive the driving shaft to rotate directly.

The fixing manner between the handle 24 and the driving shaft may be a detachable fixation or a non-detachable fixation.

Embodiment 9

Figure 8:
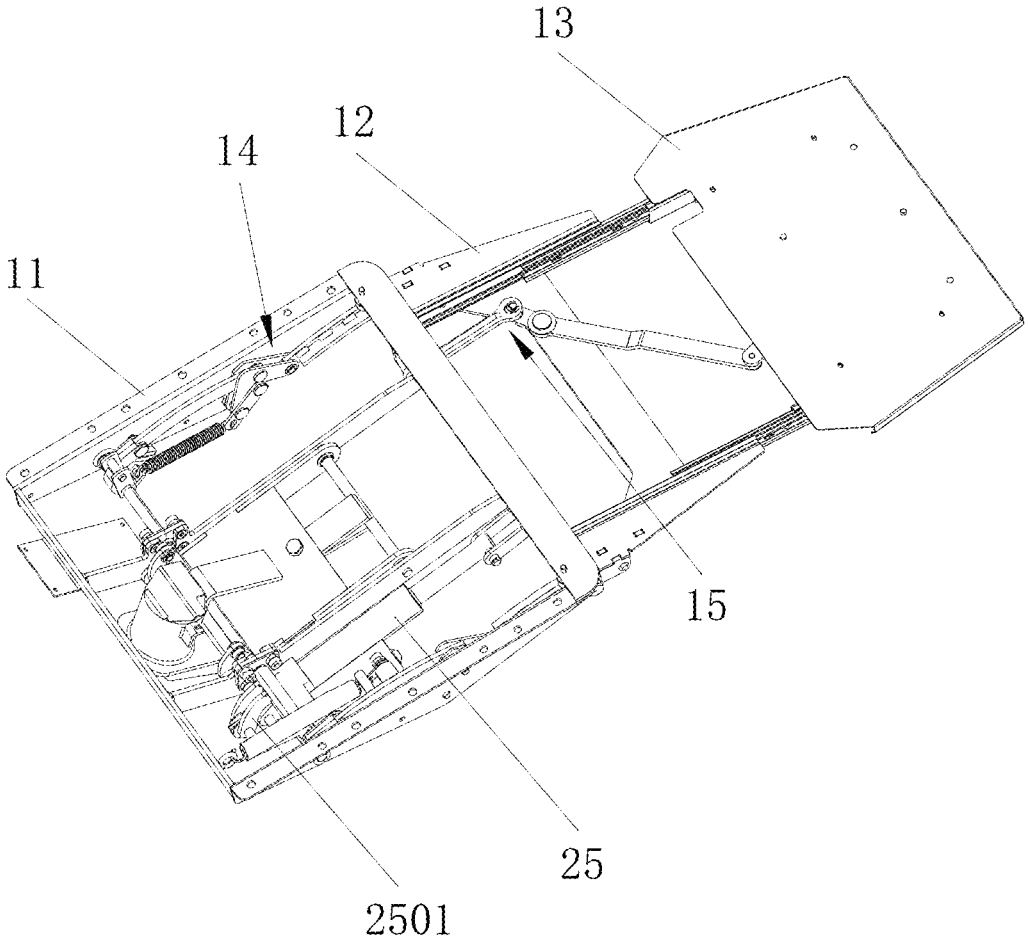
FIG. 8 is a structural diagram of the support structure in an embodiment of the present disclosure.

Referring to FIG. 8, the present embodiment differs from embodiment 1 only in that the driving member is a linear extendable assembly. The linear extendable assembly includes a linear extendable link 25 and a driving crank 2501. The driving crank 2501 is fixed to the rotating shaft 1401. An end of the linear extendable link 25 is hinged to the seat frame assembly 11, and an opposite end thereof is hinged to the driving crank 2501.

The linear extendable link 25 may be a motorized pusher, a pneumatic pusher, or a hydraulic pusher.

In summary, when using the support structure and the seat provided in the present disclosure, the footrest may be extended through the handle 24 or by means of an electric actuation, and the hinge point between the first crank 14013 and the rear driving link 1402 is abutted against the restricting block 1101. When a person lies or sits on the seat frame assembly 11, human gravity applies a moment M to the seat frame assembly 11. The moment M overcomes the elastic forces of the first reset elastic member 16 and the second reset elastic member 21 to keep the rotating shaft 1401 locked, causing the linkage mechanism to form a self-locking, in which the linkage mechanism is formed by the first crank 14013, the rear driving link 1402, the middle driving link 1403, and the front driving link 1404, i.e., the human gravity being utilized to provide support for the footrest.

When a person stands up, without the suppression of weight, the seat frame assembly 11 achieves a reset of the inclination under an action of the second reset elastic member 21. The rear footrest assembly 12 and the front footrest assembly 13 are retracted with the assistance of the first reset elastic member 16, which may serve to power-saving in a drive mode of the linear extendable link, and may achieve automatic folding and storing in a manual drive mode, with fast retraction speed, having the advantages of convenient, labor-saving, and swiftness.

In summary, the support structure and the seat provided in the present disclosure provide technical effects as follows:

The support structure in the present disclosure adopts a first reset elastic member to assist footrest retraction, reducing the force required to retract, with fast retraction speed, providing advantages of convenience, labor-saving, and swiftness.

In the support structure of the present disclosure, when the seat frame assembly is under pressure, it also provides a function of allowing the motion-driving assembly to be self-locked. Specifically, the seat frame assembly is provided to swing up and down with respect to the fixed mounting base. The fixed mounting base is rotatably connected to the motion-driving assembly through the support link. When the seat frame assembly is under pressure and swings down with respect to the fixed mounting base, the support link provides a holding force for self-locking of the motion-driving assembly so as to achieve the self-locking of the motion-driving assembly, thereby maintaining the footrest assembly in an outward open state, which is an ingenious structure.

The support structure further includes a reset mechanism. The provision of the reset mechanism achieves a reset of an inclination of the seat frame assembly with respect to the support base.

By providing a four-bar mechanism formed by the second crank, the support link, the fixed mounting base, and the seat frame assembly, when a person sits on the seat frame assembly or downward pressure is applied to the seat frame assembly, the support link applies a driving force to the rotating shaft through the second crank to result in a moment, which achieves the self-locking of the motion-driving assembly. However, when a person stands up or the pressure applied is removed, an elastic force generated by the first reset elastic member may assist in the retraction of the footrest, which is an ingenious self-locking structure, rendering a quick and convenient retraction.

The seat provided in the present disclosure provides the advantage of rapid and convenient storage, having relatively good application and market prospects.

The technical means disclosed in the solution of the present disclosure are not limited to those disclosed in the embodiments mentioned above but also include technical solutions consisting of any combination of the above technical features. It should be noted that for those skilled in the art, many improvements and modifications may be made without departing from the principles of the present disclosure. These improvements and modifications are also considered to be within the scope of protection of the present disclosure.

The invention claimed is:

1. A support structure, comprising:

a seat frame assembly;

a footrest assembly, rotatably connected to the seat frame assembly;

a motion-driving assembly, used to drive the footrest assembly to rotate with respect to the seat frame assembly; and a first reset elastic member, provided on the seat frame assembly and connected to the motion-driving assembly or the footrest assembly, wherein the first reset elastic member applies a reset elastic force to directly or indirectly drive the footrest assembly to rotate with respect to the seat frame assembly to retract;

wherein the support structure further comprises a fixed mounting base and a support link, wherein the seat frame assembly, swingable up and down, is hinged to the fixed mounting base, and both ends of the support link are rotatably connected to the motion-driving assembly and the fixed mounting base respectively; and with the footrest assembly in an outwardly open state, when the seat frame assembly is compressed and swings downwardly with respect to the fixed mounting base, the seat frame assembly drives the motion-driving assembly to self-lock by means of the support link.

2. The support structure according to claim 1, further comprising an elastic reset mechanism provided between the fixed mounting base and the seat frame assembly, wherein the elastic reset mechanism is used to drive the seat frame assembly to rotate with respect to the fixed mounting base to achieve a reset.

3. The support structure according to claim 2, wherein the elastic reset mechanism comprises a reset rotating shaft and a compression spring; the seat frame assembly is hinged to the fixed mounting base by means of the reset rotating shaft; the reset rotating shaft is fixed to the seat frame assembly;

the reset rotating shaft is fixedly connected with a reset plate; the fixed mounting base is fixed with a stud; the stud passes through the reset plate and is threaded to a fixing nut; the compression spring is sleeved on the stud; an end of the compression spring is abutted against the fixing nut; and an opposite end of the compression spring applies an elastic force to the reset plate so that the reset plate is abutted against to the fixed mounting base.

4. The support structure according to claim 1, wherein the motion-driving assembly comprises a rotatably connectable rotating shaft, a rear driving link, a middle driving link, and a front driving link sequentially; the rotating shaft is rotatably connected to the seat frame assembly; the front driving link is rotatably connected to the footrest assembly; and the first reset elastic member is connected to at least one of the following: the rotating shaft, the rear driving link, the middle driving link, and the front driving link.

5. The support structure according to claim 4, wherein a first crank hinged to the rear driving link and a second crank hinged to the support link are both fixed to the rotating shaft; and with the footrest assembly in an outwardly open state, when the seat frame assembly is compressed and swings downwardly with respect to the fixed mounting base, the seat frame assembly drives the rotating shaft to rotate so that a hinge point of the first crank and the rear driving link is maintained at or bypassed at a dead center for self-locking of the motion-driving assembly.

6. The support structure according to claim 5, wherein a restricting block for restricting a rotation angle of the first crank is fixed to the seat frame assembly, and the restricting block is positioned between the rotating shaft and the middle driving link.

7. The support structure according to claim 1, further comprising a handle in transmission connection with the motion-driving assembly.

8. The support structure according to claim 1, further comprising a linear extendable assembly in transmission connection with the motion-driving assembly.

9. A seat, comprising a support structure, the support structure comprising:

a seat frame assembly;

a footrest assembly, rotatably connected to the seat frame assembly;

a motion-driving assembly, used to drive the footrest assembly to rotate with respect to the seat frame assembly; and a first reset elastic member, provided on the seat frame assembly and connected to the motion-driving assembly or the footrest assembly, wherein the first reset elastic member applies a reset elastic force to directly or indirectly drive the footrest assembly to rotate with respect to the seat frame assembly to retract;

wherein the support structure further comprises a fixed mounting base and a support link, wherein the seat frame assembly, swingable up and down, is hinged to the fixed mounting base, and both ends of the support link are rotatably connected to the motion-driving assembly and the fixed mounting base respectively; and with the footrest assembly in an outwardly open state, when the seat frame assembly is compressed and swings downwardly with respect to the fixed mounting base, the seat frame assembly drives the motion-driving assembly to self-lock by means of the support link.

10. The seat according to claim 9, wherein the support structure further comprises an elastic reset mechanism provided between the fixed mounting base and the seat frame assembly, wherein the elastic reset mechanism is used to drive the seat frame assembly to rotate with respect to the fixed mounting base to achieve a reset.

11. The seat according to claim 10, wherein the elastic reset mechanism comprises a reset rotating shaft and a compression spring; the seat frame assembly is hinged to the fixed mounting base by means of the reset rotating shaft; the reset rotating shaft is fixed to the seat frame assembly;

the reset rotating shaft is fixedly connected with a reset plate; the fixed mounting base is fixed with a stud; the stud passes through the reset plate and is threaded to a fixing nut; the compression spring is sleeved on the stud; an end of the compression spring is abutted against the fixing nut; and an opposite end of the compression spring applies an elastic force to the reset plate so that the reset plate is abutted against to the fixed mounting base.

12. The seat according to claim 9, wherein the motion-driving assembly comprises a rotatably connectable rotating shaft, a rear driving link, a middle driving link, and a front driving link sequentially; the rotating shaft is rotatably connected to the seat frame assembly; the front driving link is rotatably connected to the footrest assembly; and the first reset elastic member is connected to at least one of the following: the rotating shaft, the rear driving link, the middle driving link, and the front driving link.

13. The seat according to claim 12, wherein a first crank hinged to the rear driving link and a second crank hinged to the support link are both fixed to the rotating shaft; and with the footrest assembly in an outwardly open state, when the seat frame assembly is compressed and swings downwardly with respect to the fixed mounting base, the seat frame assembly drives the rotating shaft to rotate so that a hinge point of the first crank and the rear driving link is maintained at or bypassed at a dead center for self-locking of the motion-driving assembly.

14. The seat according to claim 13, wherein a restricting block for restricting a rotation angle of the first crank is fixed to the seat frame assembly, and the restricting block is positioned between the rotating shaft and the middle driving link.

15. The seat according to claim 9, wherein the support structure further comprises a handle in transmission connection with the motion-driving assembly.

16. The seat according to claim 9, wherein the support structure further comprises a linear extendable assembly in transmission connection with the motion-driving assembly.

* * * * *